US005835839A

United States Patent [19]

Kaneda

[11] Patent Number: 5,835,839

[45] Date of Patent: Nov. 10, 1998

[54] SORTER HAVING A CONTROLLER FOR SETTING THE CONVEYING MEANS OF THE SORTER AND IMAGE FORMING APPARATUS HAVING THE SAME

[75] Inventor: Hiroshi Kaneda, Ibaraki, Japan

[73] Assignee: Riso Kagaku Corporation, Tokyo, Japan

[21] Appl. No.: 855,569

[22] Filed: May 13, 1997

[30] Foreign Application Priority Data

May 13, 1996 [JP] Japan ..... 8-117728

[51] Int. Cl.[6] ..... G03G 15/00

[52] U.S. Cl. ..... 399/361; 399/403

[58] Field of Search ..... 399/407, 361, 399/45, 23, 403, 405

[56] References Cited

U.S. PATENT DOCUMENTS

| | | | |
|---|---|---|---|
| 4,835,573 | 5/1989 | Rohrer et al. | 399/23 |
| 5,138,178 | 8/1992 | Wong et al. | 399/45 X |
| 5,289,250 | 2/1994 | Hiroi et al. | 399/405 |
| 5,392,107 | 2/1995 | Paxon et al. | 399/361 |
| 5,486,903 | 1/1996 | Kanno et al. | 399/45 |
| 5,689,760 | 11/1997 | Suzuki et al. | 399/45 |

*Primary Examiner*—S. Lee

*Attorney, Agent, or Firm*—Sughrue, Mion, Zinn, Macpeak & Seas, PLLC

[57] ABSTRACT

A sorter for sorting a printed sheet discharged from an image forming machine has a controller for determining the appropriate air-suction force of a suction unit of a conveyer based on information sent from a control panel. A plurality of bins are arranged vertically and the conveyer is arranged vertically alongside the bins so that the printed sheet is conveyed downward. The conveyor has a belt and the suction unit for drawing the printed sheet to the belt and an indexer has a guide surface in its upper portion, which moves vertically along a sheet travel route of the conveyer, for peeling the printed sheet off the conveyer with the guide surface and sending the printed sheet into one of the bins. The controller is connected to the conveyer and the indexer and drives the conveyer and the indexer according to the information from the control panel. An operating panel also is connected to the controller and receives printing sheet information regarding the sheet to be printed and feeds this information to the controller.

13 Claims, 10 Drawing Sheets

SORTER HAVING A CONTROLLER FOR SETTING THE CONVEYING MEANS OF THE SORTER AND IMAGE FORMING APPARATUS HAVING THE SAME

BACKGROUND OF THE INVENTION

The present invention relates to a sheet post-processing unit such as a sorter for distributing and accommodating printed sheets discharged from the image forming machine, and to an image forming apparatus having the sheet post processing unit and an image forming machine such as a copying machine, a printer and the like for forming images on a printing sheet.

Various types of sheet post-processing units for distributing sheets of printing paper which have images formed thereon and discharged from a stencil printing machine have heretofore been developed and put to practical use. Sheet post-processing units of the sorts mentioned above are desired to be devised so that while every possible effort is made for size reduction, a larger number of printing sheets may be distributable.

In such a sheet post-processing unit of a fixed bin type, a plurality of bins are fixedly arranged in the vertical direction of a casing and conveyer units having fans and blowers are installed in the vertical direction of the plurality of bins and besides indexers as sheet guide means for carrying the printed sheets into the corresponding bins are lifted up and down vertically along travel routes of the conveyer units. Therefore, an attempt has been made to reduce the size of the whole apparatus by decreasing the dimension in the depth direction thereof. With respect to the conveyer unit, moreover, the diameter of a corner portion at both ends of a belt has also been designed for its size to be minimized. However, the following problems still exit because various kinds of sheet are used as printing sheets in the stencil printing machine connecting with aforementioned sheet post-processing unit.

When it is attempted to use the belt for conveying the printed sheet discharged from the stencil printing machine by means of the sheet post-processing unit thus arranged while the printed sheet is being drawn to the belt, the travel route is largely curved in the corner portion of a belt 94*a* in a belt conveyer unit 94 as shown in FIG. 11.

When the printed sheet discharged and conveyed from the stencil printing machine is changed from ordinary printing paper to a firm one, the printing paper tends to stand out of the belt 94*a* after it has made a U-turn and passed the corner portion of the belt 94*a*.

Consequently, the printing paper is conveyed at an acute angle with respect to an indexer 116 as shown by an arrow A and caused to strike against the surface of the indexer 116 in a manner sticking therein. Therefore, the printing paper becomes unaccommodated in a target bin 78, which also poses a problem causing a paper jam. If, moreover, excessively strong suction force is used for thin printing paper, the printing paper becomes hardly peeled off the belt 94*a* by the indexer 116 when the printing paper has reached the indexer 116.

SUMMARY OF THE INVENTION

In view of the foregoing problems, an object of the present invention is to provide an image forming apparatus capable of reducing a paper jam percentage by stably conveying printing sheet which tends to deviate from a travel route.

In order to accomplish the above and other objects, an image forming apparatus according to the first aspect of the present invention having conveyer means for conveying printing sheets discharged from image forming means toward a sheet post-processing unit with a belt while having the printing sheet air-drawn to the belt using air-suction means, further comprising: printing sheet information input means for inputting information concerning the thickness of the printing sheet; and control means for controlling the air-suction force of the air-suction means of the conveyer means in response to the output of the printing sheet information input means.

According to a second aspect of the invention, there is provided an image forming apparatus having conveyer means for conveying printed sheets discharged from image forming means toward a sheet post-processing unit with a belt while having the printing sheet air-drawn to the belt using air-suction means, further comprising: printing paper information input means for inputting information concerning the density of the printing sheet; and control means for controlling the air-suction force of the air-suction means of the conveyer means in response to the output of the printing paper information input means.

According to a third aspect of the invention, there is provided an image forming apparatus comprising: a plurality of bins arranged in the vertical direction; first conveyer means for conveying printed sheets discharged from image forming means with a belt while having the printing sheet air-drawn to the belt using air-suction means; second conveyer means which is provided in the vertical direction along the plurality of bins, connected to the downstream side of the first conveyer means in a winding way and used for conveying the printed sheet downward vertically on receiving the printed sheet conveyed by the first conveyer means while having the printed sheet air-drawn to the belt using air-suction means; distributing means for distributing the printed sheets conveyed by the second conveyer means into the plurality of corresponding bins, respectively; control means for controlling the driving of the first conveyer means, the second conveyer means and the distributing means in accordance with the printed sheet discharged from the image forming means; and printing sheet information input means for inputting information concerning the thickness of the printing sheet, wherein the control means controls the air-suction force of the air-suction means of the second conveyer means in response to an output of the printing sheet information input means.

According to a fourth aspect of the invention, there is provided an image forming apparatus comprising: a plurality of bins arranged in the vertical direction; first conveyer means for conveying printed sheets discharged from image forming means with a belt while having the printed sheet air-drawn to the belt using air-suction means; second conveyer means which is provided in the vertical direction along the plurality of bins, connected to the downstream side of the first conveyer means in a winding way and used for conveying the printed sheet downward vertically on receiving the printed sheet conveyed by the first conveyer means while having the printed sheet air-drawn to the belt using air-suction means; distributing means for distributing the printed sheets conveyed by the second conveyer means into the plurality of corresponding bins, respectively; control means for controlling the driving of the first conveyer means, the second conveyer means and the distributing means in accordance with the printed sheet discharged from the image forming means; and printing paper information input means for inputting information concerning the density of the printing sheet, wherein the control means controls the air-suction force of the air-suction means of the second conveyer means in response to an output of the printing sheet information input means.

In the image forming apparatus according to either first or third aspect of the present invention, the printing sheet information input means may input to the control means information concerning the thickness of the printing sheet in the form of a signal which is turned on or off as the sheet-feed-pressure of the printing sheet supplied to the image forming means varies.

In the image forming apparatus according to either first or third aspect of the invention, the printing sheet information input means may input to the control means information concerning the thickness of the printing sheet in the form of a key signal which is generated in accordance with the thickness of the printing sheet. In the image forming apparatus according to either second or fourth aspect of the invention, moreover, the printing sheet information input means may input to the control means information concerning the density of the printing sheet in the form of a key signal which is generated in accordance with the density of the printing sheet.

According to the present invention, information concerning the thickness of the printing sheet and the like is usable for variably controlling the air-suction force of the air-suction means in the conveyer means, whereby the printing sheet which tends to deviate from the travel route can be conveyed up to the target bin with stability while being drawn to the belt. Thus, a paper jam percentage becomes reducible.

DETAILED DESCRIPTION OF THE PREFERRED EMBODIMENTS

Figure 1:
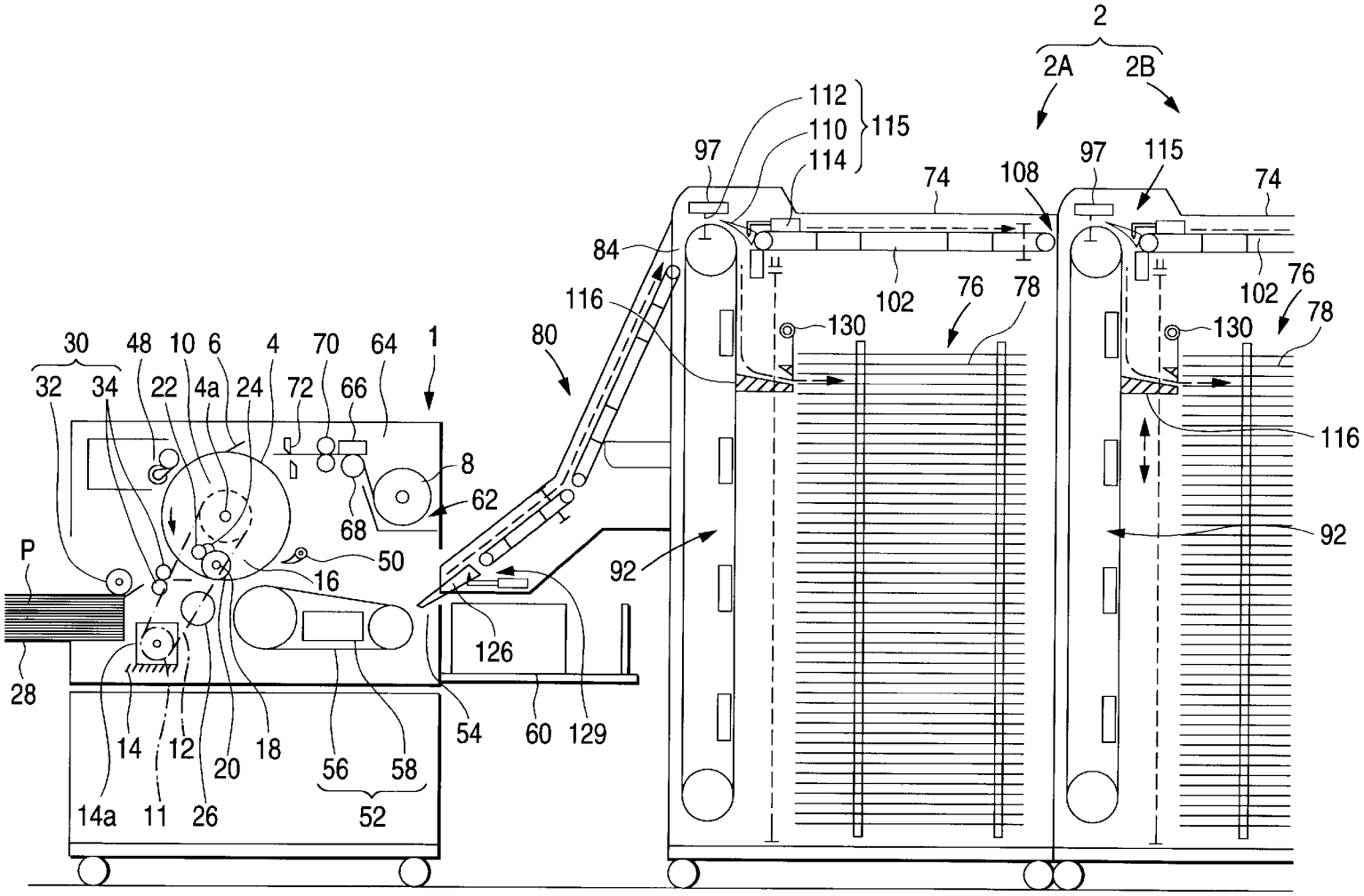
FIG. 1 is an overall block diagram of an image forming apparatus according to the present invention.

FIG. 1 is an overall block diagram of an image forming apparatus according to the present invention. The image forming apparatus roughly comprises a stencil printing machine 1 as an image forming machine and a sorter 2 as a sheet post-processing unit.

A description will be given of the construction of the stencil printing machine 1 first. The stencil printing machine 1 has a cylindrical drum 4 rotatably supported with a machine frame (not shown) round the center axis of the cylindrical drum 4. The cylindrical drum 4 is porous in structure and has a clamp mechanism 6 on its outer peripheral portion. The clamp mechanism 6 retains one end of a stencil 8.

The cylindrical drum 4 is coupled to and driven by a sprocket 10 installed in a manner coaxial with the center axis 4*a*. An endless belt 12 is used for coupling the sprocket 10 to the driving sprocket 11 of the cylindrical drum driving motor 14*a* of a drum driving mechanism 14. The motive power of the drum driving motor 14*a* of the drum driving mechanism 14 works to drive the cylindrical drum 4 to rotate counterclockwise intermittently or continuously.

A printing ink supply means 16 is provided in the body of the cylindrical drum 4. The printing ink supply means 16 is disposed so that its outer peripheral face is brought into contact with the inner peripheral face of the cylindrical drum 4. The printing ink supply means 16 has a squeegee roller 20 capable of rotation round the center axis 18 of the printing ink supply means 16 and a doctor roller 22 extending along the direction of the generating line of the squeegee roller 20 with a predetermined space left with respect to the outer peripheral face of the squeegee roller 20. The printing ink supply means 16 is used for supplying printing ink in an ink reservoir 24 to the inner peripheral face of the cylindrical drum 4 when the squeegee roller 20 is driven to rotate synchronously in the same direction in which the cylindrical drum 4 rotates.

The printing ink in the ink reservoir 24 is passed through the space between the squeegee roller 20 and the doctor roller 22 as the squeegee roller 20 rotates, when the ink is metered so that a printing ink layer uniform in thickness may be formed on the outer peripheral face of the squeegee roller 20. The printing ink layer is applied to the inner peripheral face of the cylindrical drum 4 for printing purposes as the squeegee roller 20 rotates. A press roller 26 for pressing a printing sheet P (a printing paper in this embodiment) against the cylindrical drum 4 is installed opposite to and in a position outside the cylindrical drum 4.

A sheet feed tray 28 for setting the printing sheets P to be fed between the cylindrical drum 4 and the press roller 26 is installed in a left-hand diagonally-downward position. The sheet feed tray 28 is moved up and down by a driving unit (not shown) in proportion to the quantity of laminated printing sheets P thus set thereon.

A sheet feed mechanism 30 is positioned in the proximity of the sheet feed tray 28. The sheet feed mechanism 30 has a sheet feed roller 32 made of, for example, rubber and a pair of timing rollers 34. The sheet feed roller 32 picks up the uppermost printing sheet P out of those stacked on the sheet feed tray 28 one by one and conveys that the printing sheet P toward the timing roller 34. While temporarily holding the printing sheet P conveyed from the sheet feed roller 32 in such a state as to form a predetermined roller-to-roller loop, the timing rollers 34 rotate at predetermined timing in synchronization with the cylindrical drum 4 in order to convey the printing sheet P toward the cylindrical drum 4 at the time the printing operation is performed.

A stencil discharge mechanism 48 is provided round the cylindrical drum 4 and above the sheet feed tray 28. The stencil discharge mechanism 48 is used for peeling off the used stencil wound on the outer peripheral face of the cylindrical drum 4 as the cylindrical drum 4 rotates and accommodating the stencils discharged. A printed sheet separating pawl 50 is provided round the cylindrical drum 4 and in a position opposite to the sheet feed mechanism 30.

The printed sheet separating pawl 50 is used for removing the printed sheet P subjected to printing from the cylindrical drum 4. The printed sheet P peeled off by the printed sheet separating pawl 50 is conveyed by a sheet discharge unit 52 toward a sheet discharge port 54. The paper discharge unit 52 has a belt conveyer unit 56 and a suction unit 58; while the printed sheet P peeled by the printed sheet separating pawl 50 off the cylindrical drum 4 is being air-drawn by the suction unit 58, it is conveyed by the belt conveyer unit 56 toward the sheet discharge port 54.

A sheet discharge tray 60 as a stacker unit is installed in the rear of a sheet discharge port 54. In a non-sort mode, which will be described later, that has been selected, the sheet discharge tray 60 accommodates the printed sheet P conveyed from the sheet discharge unit 52. A stencil storage unit 62 stores the continuous sheet-like stencil 8 in the form of a roll.

A making mechanism 64 is installed between the stencil storage unit 62 and the cylindrical drum 4. The making mechanism 64 has a thermal head 66 and a platen roller 68 which is positioned opposite thereto. The making mechanism 64 thermally makes up the printing stencil supplied from the stencil storage unit 62.

The thermal head 66, though not shown in FIG. 1, has a plurality of heating elements arranged in a line, that is, at fixed intervals in the main scanning direction. The heating elements of the thermal head 66 are arranged so that they selectively generate heat in response to the image information signal read by a read unit (not shown). The printing stencil made up by the making mechanism 64 is conveyed by a stencil conveyer roller 70 toward the cylindrical drum 4. There is also installed a cutter unit 72 between the making mechanism 64 and the cylindrical drum 4, the cutter unit 72 being used to cut the stencil 8 at a point of time the made-up stencil has been wound on the outer peripheral face of the cylindrical drum 4 to a desired extent.

A description will subsequently be given of the sorter 2. The sorter 2 has a bin train 76 for accommodating printed sheets P conveyed from the stencil printing machine 1. The sorter 2 is arranged so that its multi-stage connection to the stencil printing machine 1 is made possible. In the example shown in FIG. 1, two sorters 2, namely, the preceding-stage first sorter 2A and the following-stage second sorter 2B, are coupled to the stencil printing machine 1.

Figure 2:
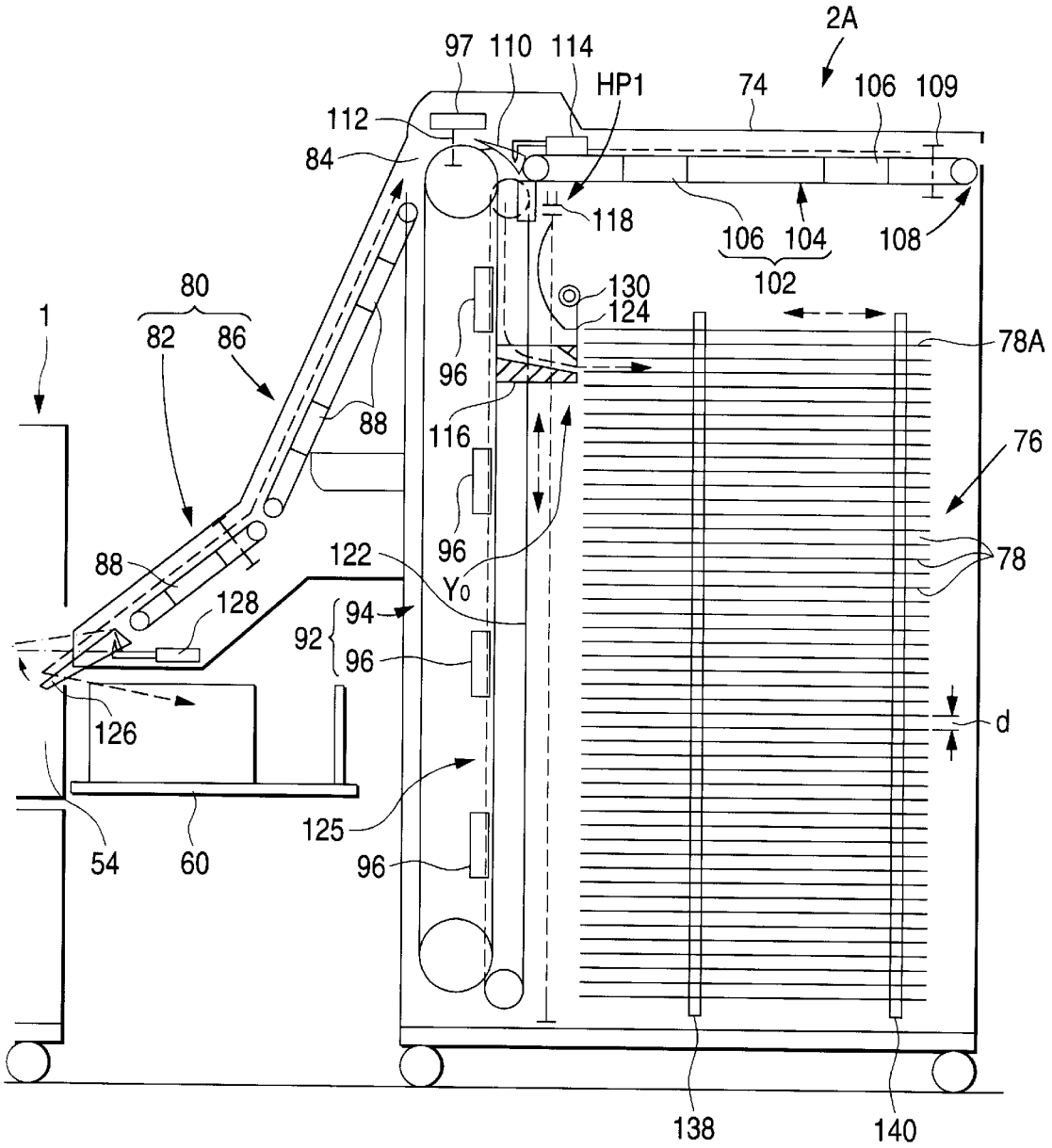
FIG. 2 is an enlarged view of a sorter in the image forming apparatus of the invention.

The first and second sorters 2A, 2B are similar in construction except that only the first sorter 2A has an approach conveyer mechanism 80, which will be described later. A detailed description will thereupon be given of the construction of only the first sorter 2A by reference of FIG. 2.

The bin train 76 is formed of a plurality of bins 78 which are each formed with the same rectangular plate member. These bins 78 are arranged in layers at predetermined intervals d in the height direction (vertical direction) of a casing 74 and fixed to the rear portion of the inside of the casing 74.

The approach conveyer mechanism 80 as a first conveyer means for introducing and conveying the printed sheet P from the stencil printing machine 1 is provided on one side of the casing 74, which side is facing the sheet discharge port 54 of the stencil printing machine 1. The approach conveyer mechanism 80 has two belt conveyer units: a preceding-stage belt conveyer unit 82 and a following-stage belt conveyer unit 86.

The belt conveyer units 82, 86 are driven by, for example, DC motors as driving means, respectively. Further, a plurality of suction units 88 in the form of blowers are provided for the respective belt conveyer units 82, 86 at predetermined intervals in the direction in which the printed sheet P is conveyed.

While air-drawing the printed sheet P discharged from the sheet discharge port 54 of the stencil printing machine 1 by means of the suction units 88, the preceding-stage belt conveyer unit 82 takes in and conveys the printed sheet P to the following-stage belt conveyer unit 86. While air-drawing the printed sheet P taken in from the preceding-stage belt conveyer unit 82 by means of the suction units 88, the following-stage belt conveyer unit 86 conveys the printed sheet P diagonally upward up to a sheet introducing port 84 in the upper end portion of one side of the casing 74. Similar to the approach conveyer mechanism 80, a bin guide conveyer mechanism 92 is fitted with a belt conveyer unit 94 and suction units 96 and driven by a driving means such as a DC motor or the like. While air-drawing the printed sheet P conveyed from the following-stage belt conveyer unit 86 up to the sheet introducing port 84 by means of the suction units 96, the bin guide conveyer mechanism 92 causes the belt conveyer unit 94 to have the printed sheet P make a U-turn in its curved corner portion and then conveys the printed sheet P downward in the vertical direction of the bin train 76.

Figure 3:
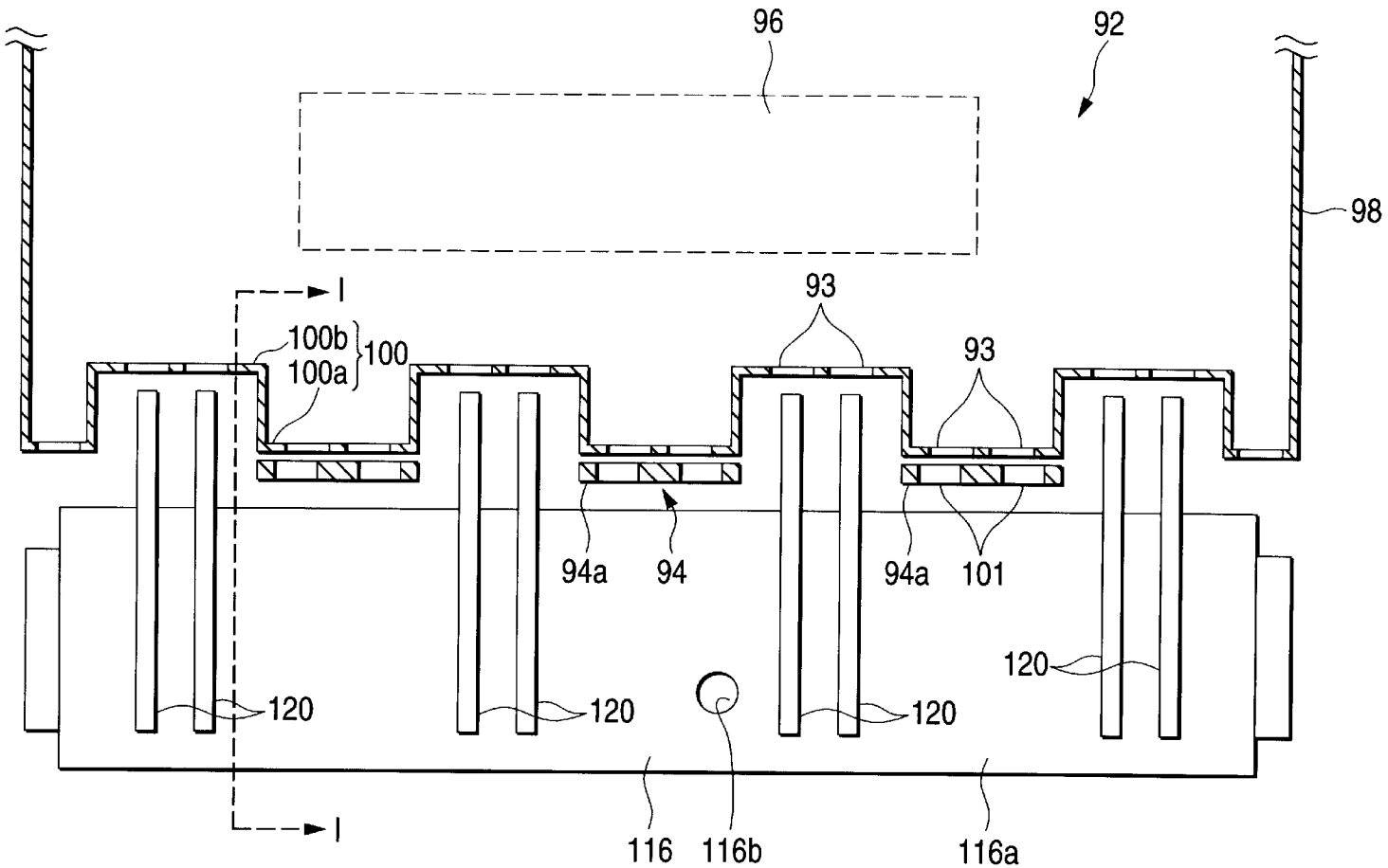
FIG. 3 is a partial enlarged view of a bin guide conveyer unit and an indexer in the image forming apparatus of the invention.
Figure 4:
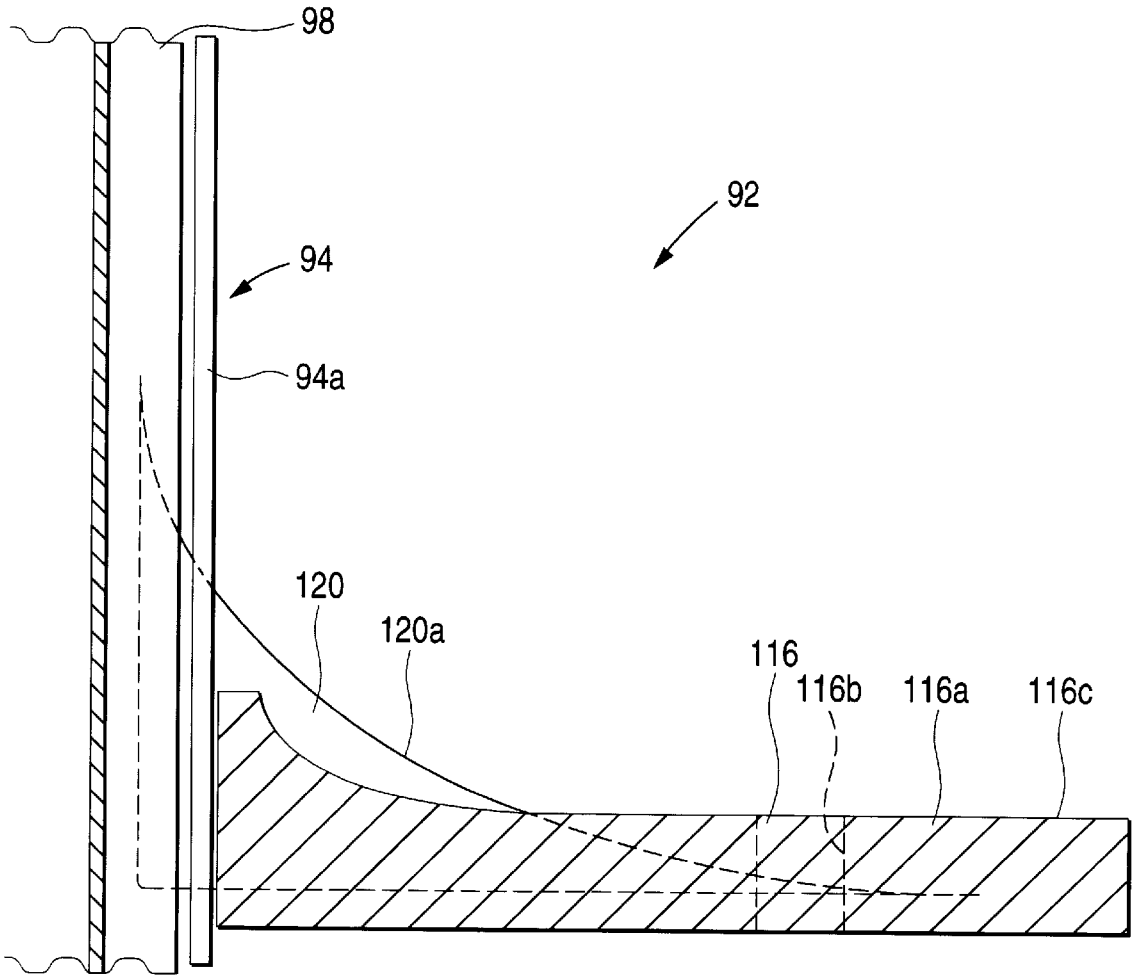
FIG. 4 is a sectional view taken on line I—I of FIG. 3.

FIG. 3 is a partial enlarged sectional view of the bin guide conveyer unit 92 and the indexer 116, which will be described later, as viewed from the upward; and FIG. 4 is a sectional view taken on line I—I of FIG. 3. A comb-like stepped portion 100 is formed in the surface of a frame 98 forming the base of the bin guide conveyer unit 92, the printed sheet P being conveyed onto the surface thereof. In the stepped portion 100, through-holes 93 for sucking the printed sheet P are formed at predetermined intervals. An endless conveyer belt 94*a* in the belt conveyer unit 94 is provided for each protrusion 100*a* of the stepped portion 100 (actually three places in this embodiment shown).

Through-holes 101 are formed in the endless conveyer belt 94*a* in positions opposite to the respective through-holes 93 of the protrusion 100*a*. The air-suction force of the suction unit 96 works to draw the printed sheet P via the through-holes 93, 101 to the surface of the conveyer belt 94*a* and the printed sheet P is conveyed in such a state that it is kept sticking to the surface of the conveyer belt 94*a*.

A fan 97 as a blower for pressing the printed sheet P conveyed from the approach conveyer mechanism 80 against the surface of the belt and sticking the printed sheet P thereon is installed in the proximity of the outer periphery of the top portion of the belt conveyer unit 94.

A sorter passage conveyer mechanism 102 for conveying the printed sheet P to the second sorter 2B connected to the preceding stage is installed above a bin train 76. Similar to the approach conveyer mechanism 80 and the bin guide conveyer mechanism 92, the sorter passage conveyer mechanism 102 has a belt conveyer unit 104 and a suction unit 106 and driven by, for example, a DC motor.

While air-drawing the printed sheet P conveyed by the following-stage belt conveyer unit 86 up to the sheet introducing port 84 by means of the suction unit 106, the sorter passage conveyer mechanism 102 discharges the printed sheet P from a sheet discharge port 108 in the upper end portion of the other side face of the casing 74 by means of the belt conveyer unit 104 and conveys the printed sheet P up to the paper introducing port 84 of the second sorter 2B. Incidentally, the sorter passage conveyer mechanism 102 is unnecessary when only one sorter 2 is connected to the stencil printing machine 1.

A sheet passage sensor 109 is installed on the exit side of the belt conveyer unit 104 in the sorter passage conveyer mechanism 102. The sheet passage sensor 109 detects the presence or absence of the printed sheet P conveyed on the belt conveyer unit 104 before being introduced into the sheet introducing port 84 of the second sorter 2B from the sheet discharge port 108.

A sorter switching plate 110 is installed in the proximity of the sheet introducing port 84 on the entrance side of the sorter passage conveyer mechanism 102. A sorter switching sensor 112 is installed in the proximity of the sheet introducing port 84 on the entrance side of the sorter switching plate 110. The sorter switching sensor 112 is used for detecting the printed sheet P introduced into the sheet introducing port 84 from the approach conveyer mechanism 80 and conveyed therethrough.

The sorter switching plate 110 is switched under the control of a solenoid 114 which is turned on and off in conformity with not only the number of printed sheets P conveyed to the preceding-stage first sorter 2A connected to the stencil printing machine 1 but also the set mode. In this case, the sorter switching plate 110, the sorter switching sensor 112 and the solenoid 114 constitute a sorter switching mechanism 115.

In the space between the bin train 76 and the bin guide conveyer mechanism 92, the indexer 116 for causing the printed sheet P to be inserted in the predetermined bin 78 of the bin train 76. As shown in FIGS. 3–4, the indexer 116 has a rectangular support portion 116a substantially equal in width to the bin 78 and remains on standby in the home position HP1 set in a position slightly above the uppermost bin 78 (78A) initially. An indexer HP sensor 118 for detecting the presence or absence of the indexer 116 is installed in the home position HP1.

Plate-like guide members 120 incorporated in the surface of the support portion 116*a* of the indexer 116 are formed at predetermined intervals in the width direction of the support portion 116*a*. In the example of FIG. 3, four sets of guide members 120 with two of them as a set are provided. The guide members 120 are uprightly provided in a position corresponding to the recess 100*b* of the frame 98 of the bin guide conveyer unit 92. The surface of the guide member 120 forms a guide surface 120*a* curving downward from the leading end close to the bin guide conveyer unit 92 up to the trailing end thereof. Further, the leading end portion of the guide member 120 is situated within a recess 100*b* of the stepped portion 100.

The indexer 116 is such that both ends of its support member 116*a* are connected via a driving belt 122 to a driving means such as a DC servo motor or the like. A columnar through-hole 116*b* is formed in a substantially central position of the support member 116*a* of the indexer 116. An indexer sensor 124 formed with a transmission type photosensor is installed in upper and lower positions in the vertical direction of the casing 74 in a manner holding the through-hole 116*b* therebetween. The indexer sensor 124 is used for detecting the printed sheet P passed on the guide plane 120*a* of the indexer 116, monitoring the situation in which the printed sheet is unarriving or stagnant on the guide plane 120*a* of the indexer 116 and also detecting a jam error. In this case, the indexer 116, the driving belt 122 and the indexer sensor 124 constitute an indexer elevating mechanism 125. Incidentally, the indexer sensor 124 may be replaced with a photo-interrupter, which is provided for the indexer 116 and used for detecting the printed sheet P passed on the guide plane 120*a* of the indexer 116.

When the indexer 116 is driven by the DC servo motor as the driving means via the driving belt 122, the tip of the printed sheet P conveyed by the bin guide conveyer unit 92 is peeled off the conveyer belt 94*a* with the tips of the guide members 120, whereby the printed paper P is received on the guide plane 120*a*. When the indexer sensor 124 detects that the printed sheet P has been accommodated in the bin train 76 for certain, the indexer 116 is made to move bin-to-bin 78 by the pitch with the home position HP1 as a reference position. Thus the printed sheet P is inserted in one corresponding bin 78 of the bin train 76 one by one.

A switching plate 126 is installed on the entrance side of the preceding-stage belt conveyer unit 82 in the approach conveyer mechanism 80. The switching plate 126 is so controlled as to be switched when a solenoid 128 is turned on or off in according with the set mode. More specifically, the switching plate 126 is switched so that the printed sheet P is conveyed to the sheet discharge tray 60 of the stencil printing machine 1 when the non-sort mode has been set. On the other hand, the switching plate 126 is switched so that the printed sheet P is conveyed to the first sorter 2A when the mode of using the second sorter 2B has been set. In this case, the switching plate 126 and the solenoid 128 constitute a switching mechanism 129.

A sheet member 130 which is wound in the form of a roll is installed in the uppermost position on the introduction end side of the uppermost bin 78A. One end of the sheet member 130 is fixedly secured to the casing 74 and the other end of the sheet member 130 as an open end is fastened to the indexer 116. The sheet member 130 operates to pay out and wind up the sheet, which operation is interlocked with the upward and downward movements of the indexer 116 and also prevents rebounding due to the sub-scan matching board 140 of a matching mechanism 136, which will be described later, when the printed sheet P is accommodated in the bin 78. Incidentally, the bin-side surface of the sheet member 130 is made a reference matching surface $Y_0$ in the sub-scan direction when the sub-scan direction of the printed sheet P inserted in the bin 78 is matched.

In each of the bins 78 constituting the bin train 76, cut portions 132, 134 having predetermined lengths are formed along the direction (sub-scan direction) in which the printed sheet P inserted from the indexer 116 is conveyed and the direction (main scan directions) perpendicular to the direction in which the printed paper P is conveyed, respectively. Further, a matching mechanism 136 for matching the printed sheet P inserted in the bin 78 with predetermined reference matching faces is provided in the positions corresponding to the cut portions 132, 134.

Figure 5:
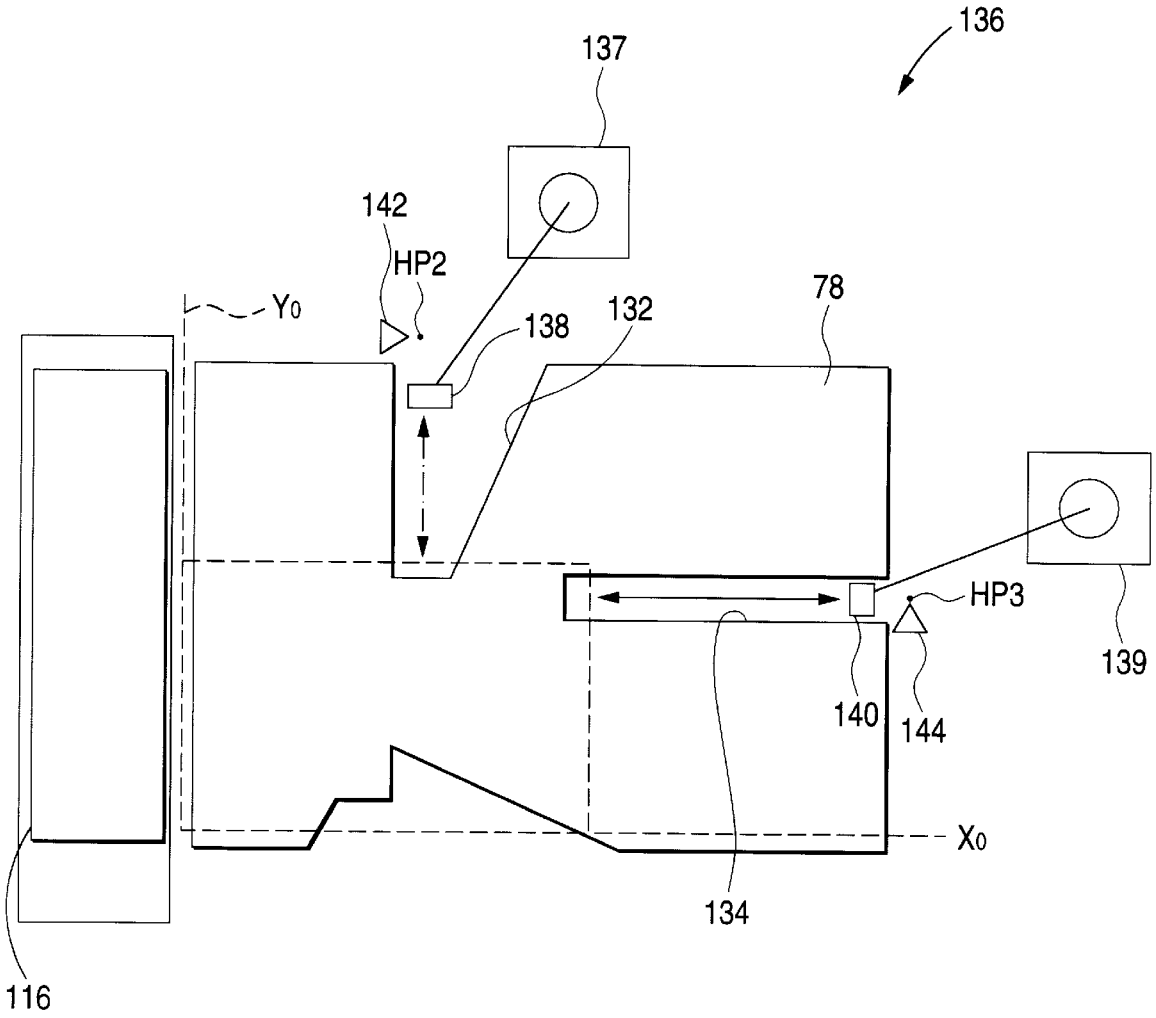
FIG. 5 is a plan view of a matching mechanism in the image forming apparatus of the invention.

FIG. 5 is a plan view of the matching mechanism 136. The reference matching faces $X_0$, $Y_0$ are set at the left lower corner of FIG. 5. More specifically, the reference matching face $Y_0$ in the sub-scan direction is set on the bin-side surface of the sheet member 130 as described above, whereas the reference matching face $X_0$ in the main scan direction is set on the inner wall surface of a cover member which can be opened and closed with respect to the casing 74, so that the cover member is made openable when the printed sheet P in the bin 78 is taken out.

The matching mechanism 136 has a main scan matching plate 138 which is moved in the main scan direction within the cut portion 132 extending in a direction perpendicular to the direction in which the printed sheet P is conveyed, and a sub-scan matching plate 140 which is moved in the sub-scan direction within the cut portion 132 extending therein.

The outermost position of the cut portion 132 is set to a main scan home position HP2 as a stand-by reference position when the main scan matching plate is moved. A main scan HP sensor 142 for detecting whether or not the main scan matching plate 138 is positioned at the main scan home position HP2 is installed in the proximity of the outermost position of the cut portion 132.

Similarly, the outermost position of the cut portion 134 is set to a sub-scan home position HP3 as a stand-by reference position when the sub-scan matching plate is moved. A sub-scan HP sensor 144 for detecting whether or not the sub-scan matching plate 140 is positioned at the sub-scan home position HP3 is installed in the proximity of the outermost position of the cut portion 134. The main scan matching plate 138 and the sub-scan matching plate 140 are connected to, for example, pulse motors 137, 139 as driving means, respectively.

In other words, the main scan matching plate 138 is moved in the main scan direction by the pulse quantity with the main scan home position HP2 as a reference when the pulse quantity of the pulse motor as the driving means is determined according to preset sheet main-scan data in conformity with the size of printing sheet. Moreover, the sub-scan matching plate 140 is moved in the sub-scan direction by the pulse quantity with the sub-scan home position HP3 as a reference when the pulse quantity of the pulse motor as the driving means is determined according to preset sheet sub-scan data in conformity with the size of printing sheet.

Thus, the main scan matching plate 138 and the sub-scan matching plate 140 are moved in conformity with the size of the printing sheet P. Accordingly, the printed sheet P inserted in each bin 78 of the bin train 76 from the indexer 116 is matched with the reference matching faces $X_0$, $Y_0$.

The size of printing sheet that can be accommodated in each bin 78 is restricted by the positional relation between the two matching plates 138, 140 and the positional relation between the HP sensors 142, 144 of the matching plates 138, 140. In other words, the minimum size of printing sheet that can be accommodated in the bin 78 becomes what is defined by moving the two matching plates 138, 140 as much as possible from the home positions HP2, HP3 up to a position where the matching plates 138, 140 are prevented from interfering with each other. Further, the maximum size of printing sheet that can be accommodated in the bin 78 becomes what allows the printing sheet to be accommodated therein without its interference with either HP sensor 142 or 144.

The stencil printing machine 1 and the sorter 2 thus arranged are connected together by mounting the approach conveyer mechanism 80 on the sheet discharge port 54 of the stencil printing machine 1. The operation of distributing and accommodating printing sheet in the bin train 76 of the sorter 2 is performed through pressing specific keys provided on the operating panel 146 of the stencil printing machine 1 as will be described below.

Figure 6:
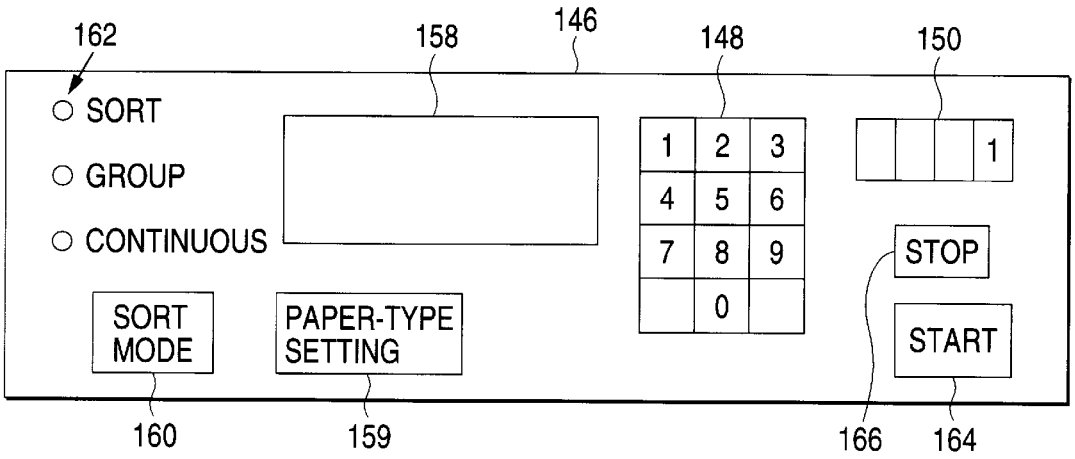
FIG. 6 is a diagram illustrating an operating panel which is installed in a stencil printing machine in the image forming apparatus of the invention.

FIG. 6 shows an operating panel mounted on a stencil printing machine. The operating panel 146 is provided with a ten key pad 148, a number-of-sheets LED 150, a display 158 such as a liquid crystal panel, a mode key 159 for setting kinds of printing paper, a sort mode key 160, a mode LED 162, a start key 164 and a stop key 166.

The ten key pad 148 includes number keys 0–9, which are used for setting the number of printing sheet and dimensions in the main scanning and sub-scanning directions of free size in a user mode.

The number-of-sheets LED 150 displays the number of sheets set by the ten key pad 148. The value displayed by the number-of-sheets LED 150 is synchronously decremented by one each time the printed sheet P is discharged during the printing operation performed by the stencil printing machine 1.

Figure 7:
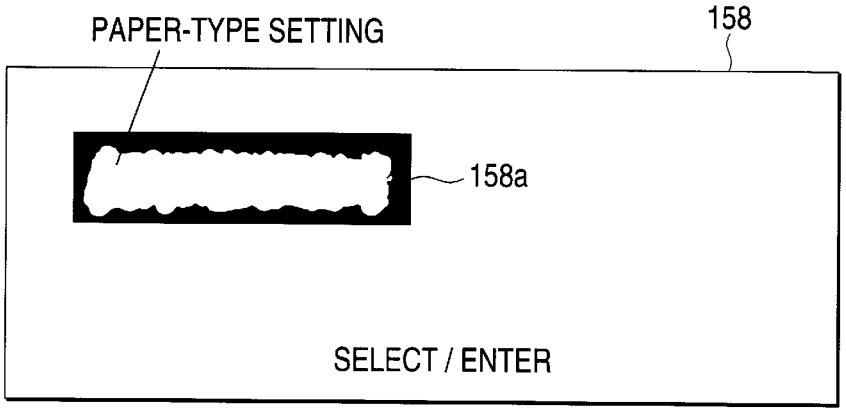
FIGS. 7(*a*) and 7(*b*) are diagrams showing examples of display screens when kinds of printing sheet are set in the image forming apparatus of the invention.
Figure 7:
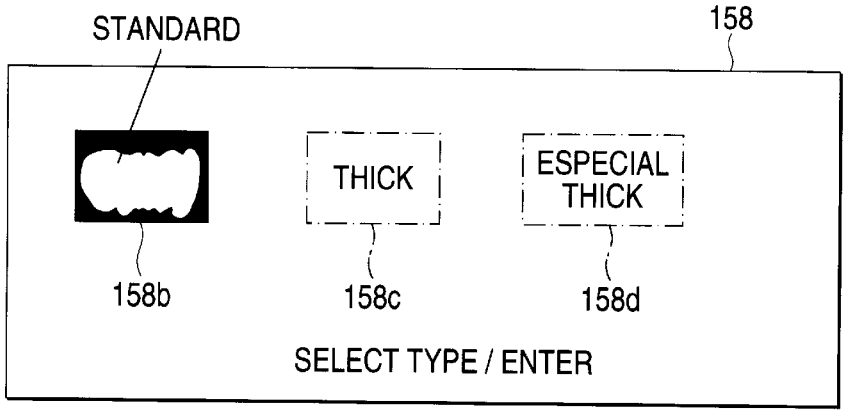

When the mode key 159 for setting kinds of printing sheet, that is, printing paper in this embodiment is pressed, the display 158 displays a screen for use in inputting a kind of printing paper in order to determine the air-suction force of the suction unit 96 in the bin guide conveyer mechanism 92. More specifically, an input display screen for displaying a key 158*a* for setting kinds of printing paper as shown in FIG. 7(*a*) is made to appear as a software key instead through the operation of the mode key 159 for setting kinds of printing paper. When the key 158*a* for setting kinds of printing paper is depressed, the screen is switched over to what displays keys 158*b*, 158*c*, 158*d* as software keys for respectively displaying kinds of printing paper (for example, three kinds of 'standard paper', 'thick paper' and 'especially thick paper') as shown in FIG. 7(*b*). In addition, the display 158 displays an error indication when an error such as a jam occurs, the size of printing paper P detected by the paper feed mechanism 30 and the like.

The mode key 159 for setting kinds of printing paper is pressed in case that a mode for changing the air-suction force of the suction unit 96 in accordance with the thickness of printing paper P to be used in the stencil printing machine 1 is to be selected.

The sort mode key 160 is pressed when one of the following modes is selected: a non-sort mode in which the printed paper P is accommodated by using the paper discharge tray 60, one of the three modes (a sort mode, a group mode and a continuous mode) in which the printed paper P is accommodated by using the sorter 2. The sort mode key 160 is used for sequentially switching the following modes each time it is pressed after the operating panel is supplied with power: namely, from non-sort mode to sort mode, group mode, continuous mode and non-sort mode in a loop.

The non-sort mode refers to a mode in which the printed paper P discharged from the sheet discharge port 54 of the stencil printing machine 1 is directly discharged onto the sheet discharge tray 60.

The sort mode refers to a mode in which the sheets of printed paper P discharged from the paper discharge port 54 of the stencil printing machine 1 are page-to-page accommodated in the bins 78 in order to gather the plurality of pages into printed matter.

The group mode refers to a mode in which the sheets of printed paper P discharged from the paper discharge port 54 of the stencil printing machine 1 are sorted into groups on a manuscript basis before being accommodated in the bins 78, which makes it possible to sort the sheets of printed paper into combinations of 'number of sheets x number of sets' on that manuscript basis.

The continuous mode refers to a mode in which the sheets of printed paper P discharged from the sheet discharge port 54 of the stencil printing machine 1 are distributed and accommodated in each bin 78 by one sheet at a time so as to reduce the back printing of printed matter.

In the mode LED 162, the mode (the sort mode, the group mode or the continuous mode) selected by the sort mode key 160 is displayed. In a case where the mode LED 162 is not displayed, the non-sort mode is selected.

The start key 164 is pressed when the operations of the stencil printing machine 1 and the sorter 2 are to be executed. The stop key 166 is pressed when the operations of the stencil printing machine 1 and the sorter 2 are to be stopped.

Figure 8:
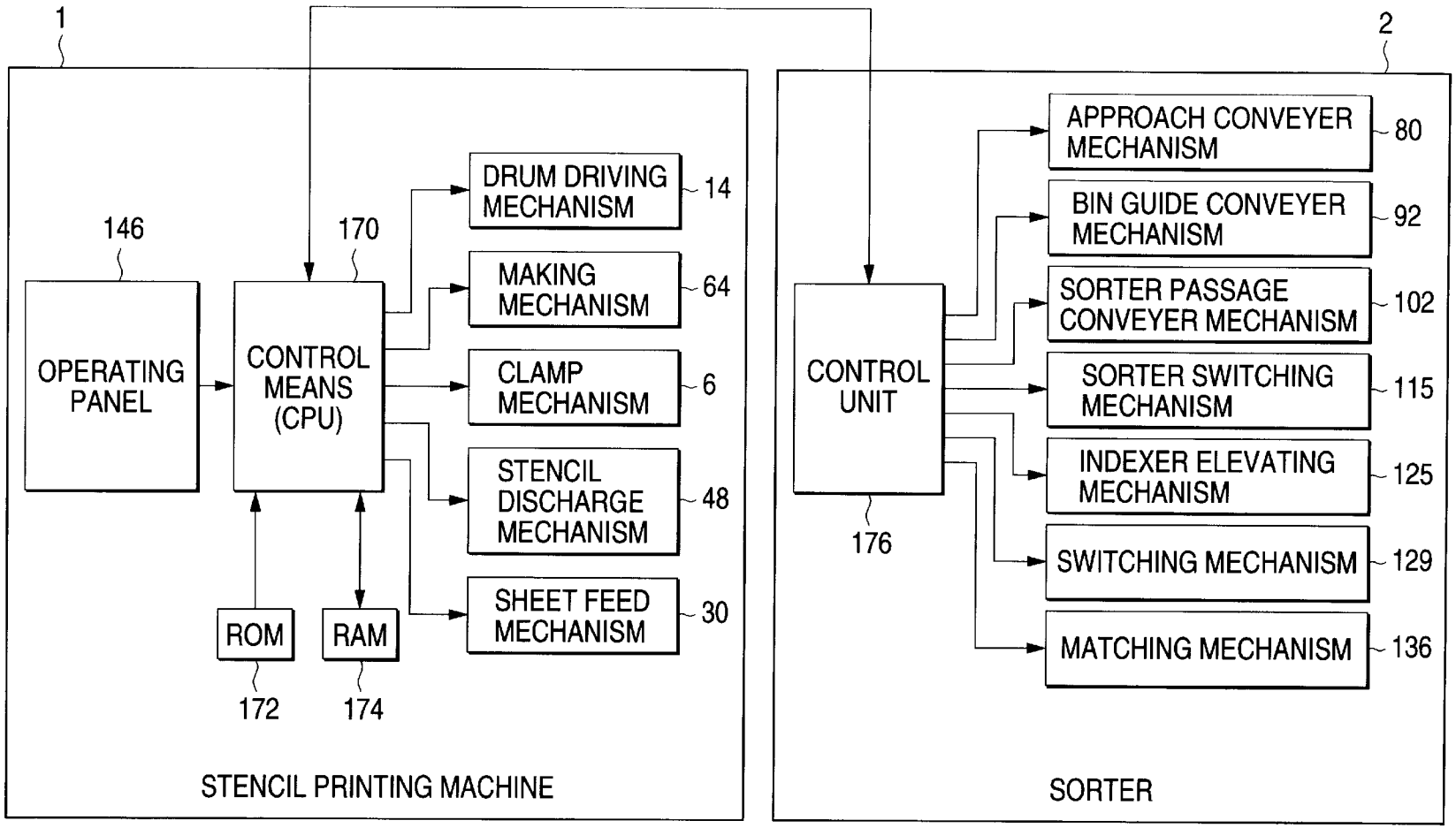
FIG. 8 is a block diagram illustrating an electrical arrangement in the image forming apparatus of the invention.

FIG. 8 is a block diagram illustrating an electrical arrangement of the aforesaid image forming system. In FIG. 8, a control means (CPU) 170 such as a microprocessor is used for controlling each of the mechanisms in the apparatus according to the program stored in a ROM 172.

A RAM 174 for storing information fed from the operating panel 146 is connected to the control means 170, which information includes the number of printing, free size at the time the user mode is set, various sort modes and the like.

The control means 170 is used for controlling the rotation of the cylindrical drum 4 by issuing a rotation command to the drum driving mechanism 14. The control means 170 also issues to the making mechanism 64 a command of making up the printing stencil 8, to the clamp mechanism 6 a command of retaining/releasing the printing stencil 8 by/from the cylindrical drum 4, to the stencil discharge mechanism 48 a command of peeling the used stencil 8 off the cylindrical drum 4, and to the sheet feed mechanism 30 a command of performing the operation of feeding the printing sheet P, which operation is interlocked with the drum driving mechanism 14.

As shown in FIG. 8, a control unit 176 for controlling the operation of each mechanism of the sorter 2 is provided on the sorter side. This control unit 176 and the control means 170 of the stencil printing machine 1 are electrically connected via a cable or the like, so that control information is exchanged therebetween. The control unit 176 is used for synchronously controlling the operation of the sorter 2 for successively taking in the sheets of printed paper P discharged one by one from the stencil printing machine 1 on the basis of control commands from the control means 170 under the control thereof.

When an error occurs on the part of the sorter 2, the control unit 176 notifies the occurrence of such an error to the control means 170 and deals with the error according to control instructions from the control means 170.

Consequently, the control unit 176 issues control commands to the approach conveyer mechanism 80, the bin guide conveyer mechanism 92, the sorter passage conveyer mechanism 102, the sorter switching mechanism 115, the indexer elevating mechanism 125, the switching mechanism 129, the matching mechanism 136 and the like in the sorter 2.

Under the command issued to each mechanism, the sheets of printed paper P discharged from the stencil printing machine 1 are sorted out and accommodated in the corresponding bins 78 in the sorter 2 in conformity with the set modes.

In this embodiment, the operating panel 146 is installed on the stencil printing machine side 1, however, a similar operating panel may be installed on the sorter side 2 so as to send set contents resulting from the operation of that operating panel to the control means 170 of the stencil printing machine 1. Moreover, the operating panels 146 may be installed in both stencil printing machine 1 and sorter 2.

Figure 9:
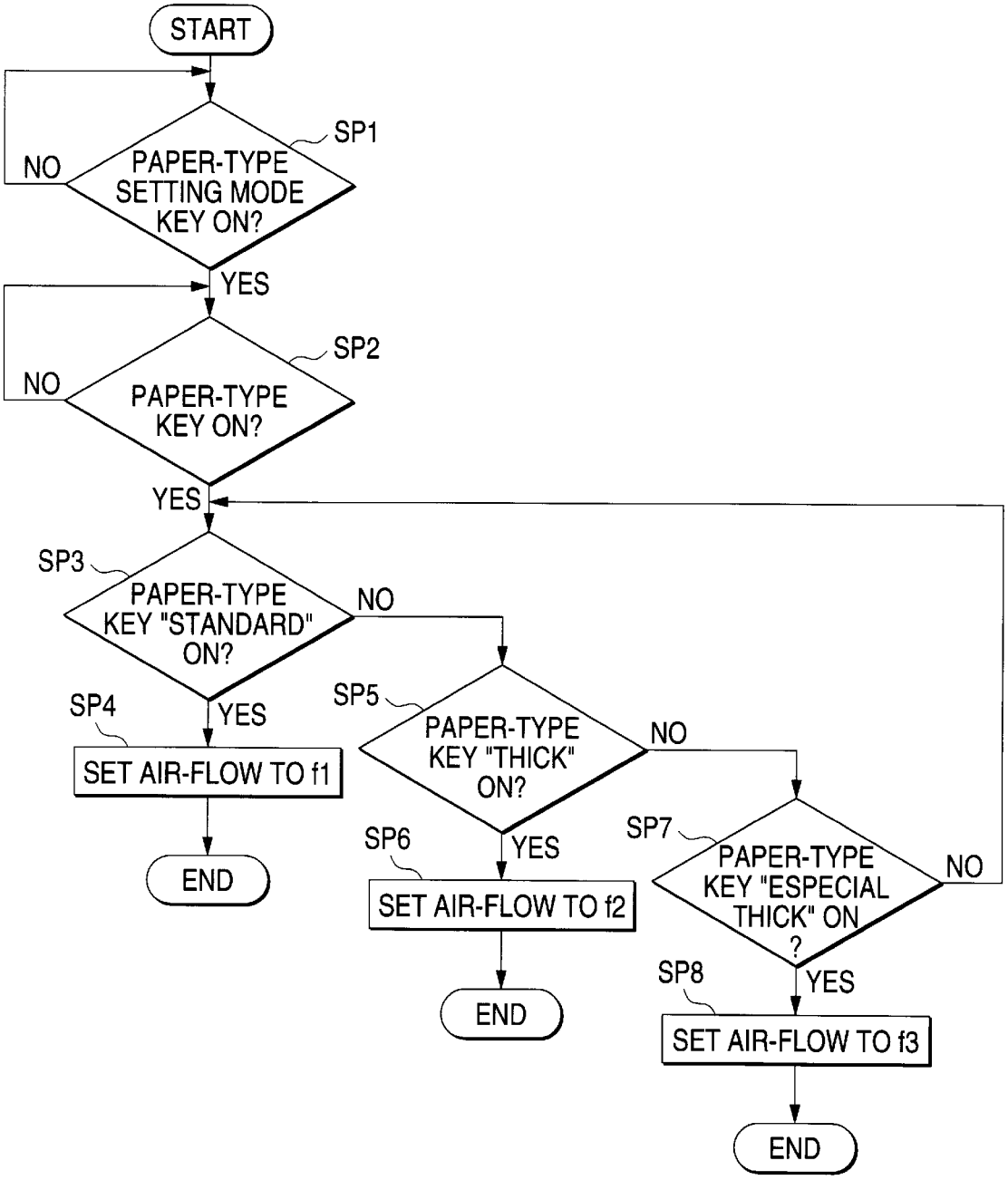
FIG. 9 is a flowchart showing a method of setting the suction force of a suction unit of a bin guide conveyer mechanism in the image forming apparatus of the invention.

In the image forming system thus arranged, an air-flow (air-suction force) producible by the blower in the suction unit 96 shown in a flowchart of FIG. 9 is set prior to the distribution of the sheets of printed paper P discharged from the stencil printing machine 1 in conformity with the respective modes.

When the mode key 159 for setting kinds of printing paper of the operating panel 146 is pressed first (SP1-Yes), a mode for setting the air-suction force of the suction unit 96 is adopted, whereby the display 158 turns to indicate an input display screen displaying the key 158*a* for setting kinds of printing paper as shown in FIG. 7(*a*). When the key 158*a* for setting kinds of printing paper is depressed ((SP2-Yes), the screen is switched over to what displays three kinds of keys 158*b*, 158*c*, 158*d* respectively displaying 'standard', 'thick' and 'especially thick' as shown in FIG. 7(*b*).

When the key 158b representing 'standard paper' is depressed (SP3-Yes), the control means 170 (or the control unit 176) sets an air-flow producible by the blower in the suction unit 96 to f1 (SP4) according to the output. When the key 158*c* representing 'thick paper' is depressed (SP5-Yes), the control means 170 (or the control unit 176) sets an air-flow producible by the blower in the suction unit 96 to f2 (SP6) according to the output. When the key 158*d* representing 'especially thick paper' is depressed (SP7-Yes), the control means 170 (or the control unit 176) sets an air-flow producible by the blower in the suction unit 96 to f3 (SP8) according to the output.

When the setting of the air-suction force of the suction unit 96 is completed in accordance with the thickness of the printing paper P used in the stencil printing machine 1, the sort printing operation is made performable hereafter. Then the mode switching plate 126 is switched over to the sorter side 2 and so is the sorter switching plate 110 to the bin guide conveyer unit side 92, whereby the printed paper P discharged from the stencil printing machine 1 is conveyed via the approach conveyer mechanism 80 up to the bin guide conveyer unit 92.

When the printed paper P is guided and conveyed by the bin guide conveyer unit 92 up to the indexer 116, the indexer 116 is moved bin-to-bin 78 by the pitch with the home position HP1 as a reference position. Thus the printed paper P is inserted in one corresponding bin 78 one by one.

While the air-suction force of the suction unit 96 in accordance with the thickness of the printing paper P is set through the operation of the operating panel 146, the indexer 116 is kept controlling variably the voltage of the motor for driving the suction unit 96 by means of the control unit 176. In other words, with the thickness of the paper being 'standard,' the driving voltage of the motor is controlled so that an air-flow of the suction unit 96 becomes f1 (e.g., 0.7 $m^3$/sec) set by pressing the key 158*b* representing the kind of printing paper. With the thickness of the paper being 'thick,' the driving voltage of the motor is controlled so that an air-flow of the suction unit 96 becomes f2 (e.g., 0.9 $m^3$/sec) set by pressing the key 158*c* representing the kind of printing paper. With the thickness of the paper being 'especially thick,' the driving voltage of the motor is controlled so that an air-flow of the suction unit 96 becomes f3 (e.g., 1.1 $m^3$/sec) set by pressing the key 158*d* representing the kind of printing paper.

Thus, the air-flow of the suction unit 96 is set at f2 or f3, which value is higher than the standard value when the printing paper P used in the stencil printing machine 1 is thick or especially thick. When the thick or especially thick printing paper P is conveyed from the paper introducing port 84 to the bin guide conveyer mechanism 92, the suction unit 96 is so controlled that it is driven in conformity with the air-flow f2 or f3 set according to the thickness of the printing paper P used in the stencil printing machine 1.

Figure 11:
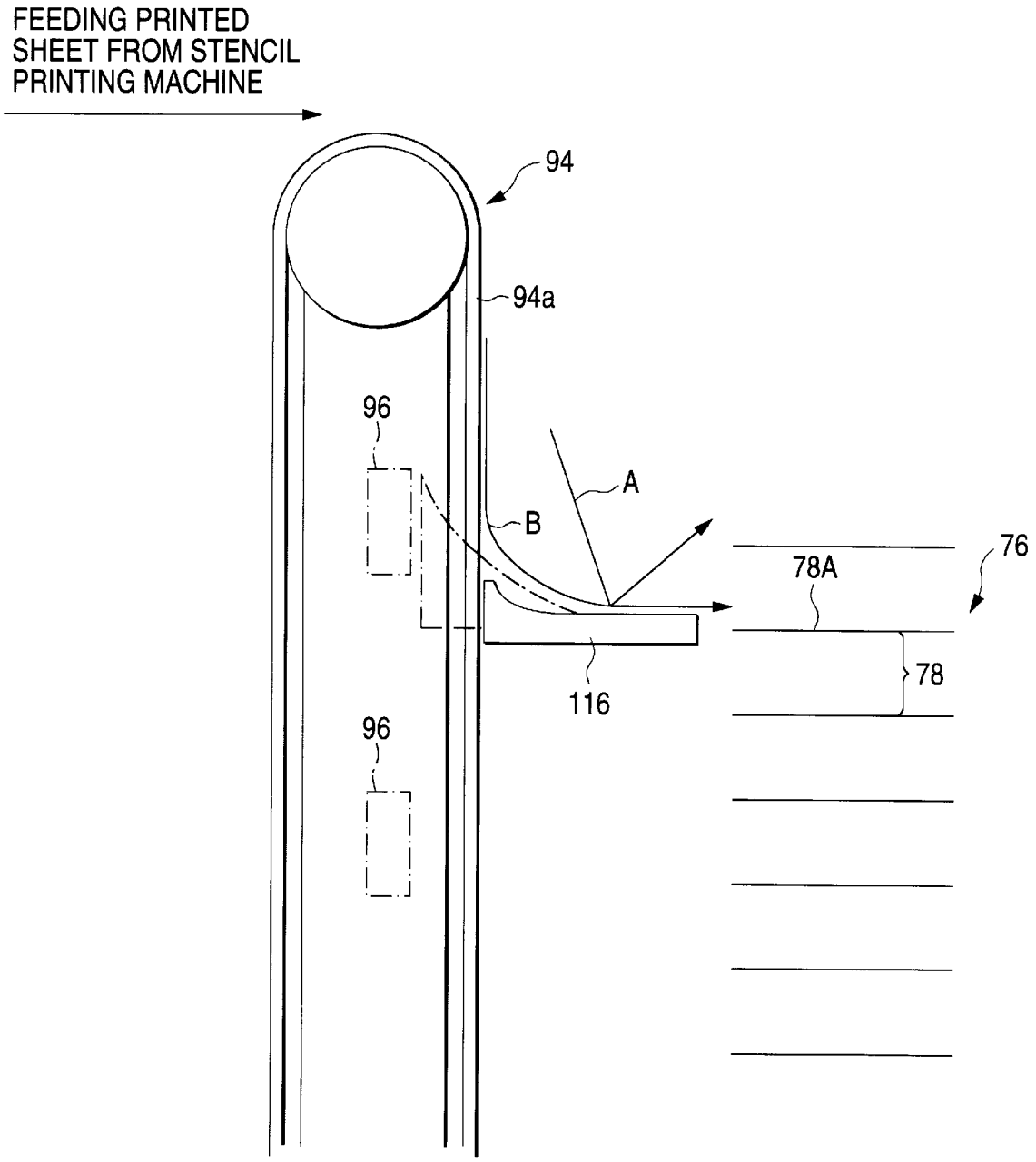
FIG. 11 is a diagram showing an ideal state in which printed sheet is conveyed to the bin and a state in which the printed sheet is conveyed in an abnormal condition.

Therefore, the printed paper P, even though it is thick, hardly deviates from the travel route when it makes a U-turn in the curved corner portion of the bin guide conveyer mechanism 92 and passes thereon. Thus, the printed paper P is prevented from being delivered to the indexer 116 at an acute angle as shown by an arrow A of FIG. 11 but inserted in the target bin 78 via the guide members 120 of the indexer 116 as shown by an arrow B of FIG. 11.

In case of a 'standard' paper, the air-suction force of the suction unit 96 is set smaller than the cases of 'thick' and 'especially thick' papers. Therefore, the paper P is prevented from jamming caused by the too large air-suction force when the paper P is separated from the belt 94*a* at the indexer 16.

Unless the use start position of the indexer 116 is specifically set, the indexer 116 is so controlled that it is moved bin-to-bin 78 by the pitch in a manner that conforms the bottom 78*a* of the bin 78 to the surface 116*c* of the indexer 116 by making the home position HP1 a reference position.

The indexer 116 in the sorter 2 is moved to a desired bin 78 in conformity with the mode (the sort mode, the group mode or the continuous mode) selected by the sort mode key 160.

Then the second sorter 2B is installed as an additional one of the first sorter 2A in order to basically sort out more sheets of printed paper P. Sheets of printed paper P are conveyed to the second sorter 2B by switching the sorter switching plate 110 over to the sorter passage conveyer unit side 102. Therefore, the printed paper P is conveyed via the sorter passage conveyer mechanism 102 to the following second sorter 2B before being inserted in the corresponding bin 78 as in the first sorter 2A.

Thus, the printed paper P is inserted in the sorter 2 (2A or 2B) in accordance with the mode (the sort mode, the group mode or the continuous mode) selected by the sort mode key 160.

Figure 10:
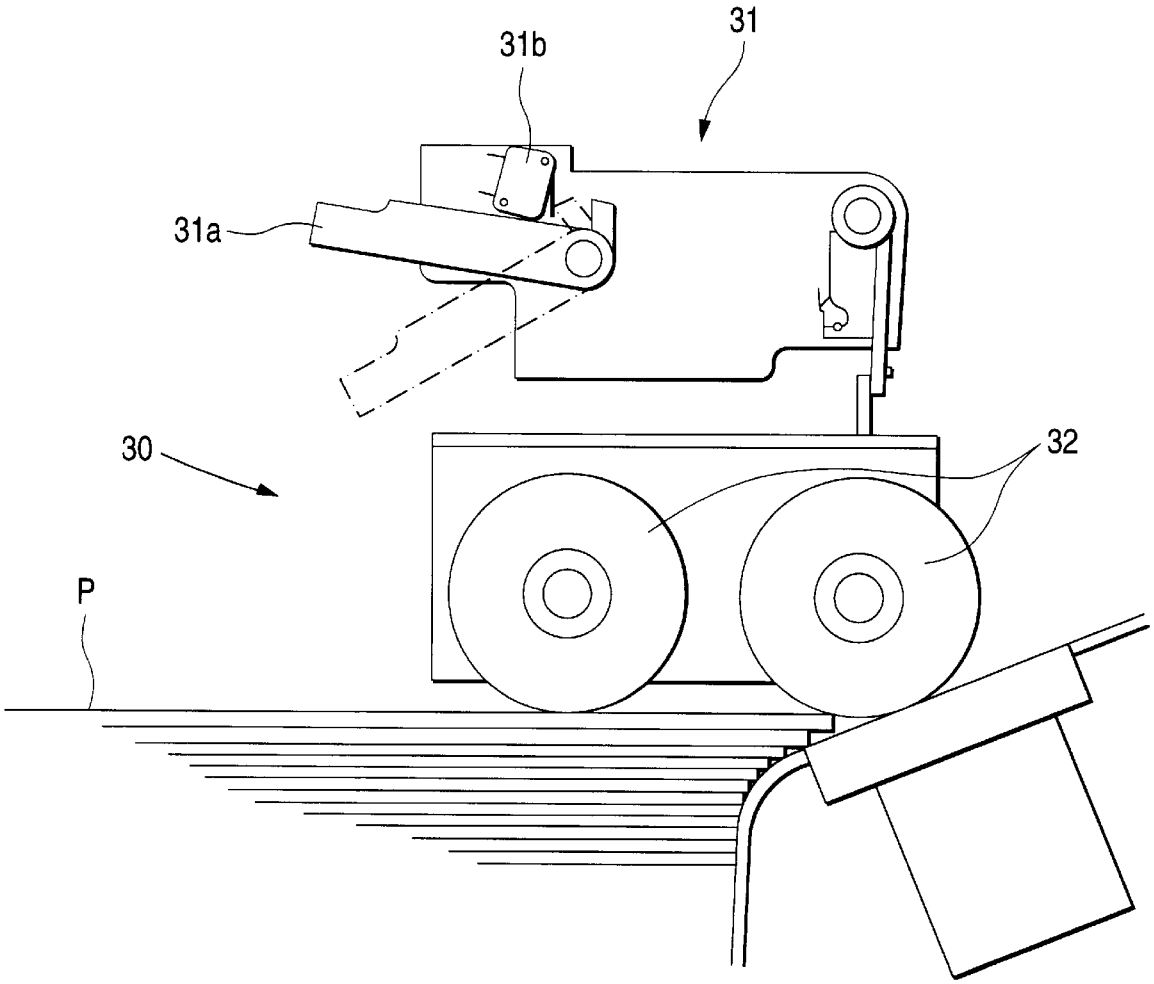
FIG. 10 is a block diagram of a paper feed mechanism for setting kinds of printing sheet in place of the operating panel in the image forming apparatus of the invention.

In this embodiment, the operating panel 146 is used to set the kind of printing sheet of paper so as to determine the air-suction force of the suction unit 96. However, the kinds of printing sheet in terms of their thickness are not limited to 'standard', 'thick' and 'especially thick' but may include other kinds of thickness to be allocated. At this time, it is unnecessary to allocate a key to each kind of thickness and provided a combination of keys is set, a smaller number of keys may be used for setting more kinds of thickness. A sheet-feed-pressure varying mechanism shown in FIG. 10 may be used for setting the air-suction force of the suction unit 96.

The sheet-feed-pressure varying mechanism 31 is provided for the sheet feed mechanism 30 of the stencil printing machine 1 and fitted with a lever 31*a* for varying the sheet feed pressure in accordance with the thickness of the printing sheet P mounted on the sheet feed tray 28, and a microswitch 31*b* which is turned on and off as the lever 31*a* is turned.

In the sheet-feed-pressure varying mechanism 31, the lever 31*a* is situated (as shown by a solid line of FIG. 10) so as to turn off the microswitch 31*b* when the printing sheet P mounted on the sheet feed tray 28 is 'standard' in thickness. The lever 31*a* is also situated (as shown by a chain line of FIG. 10) so as to turn on the microswitch 31*b* when the printing sheet P mounted on the paper feed tray 28 is 'thick.' Thus, information about the thickness of the printing sheet P is obtainable.

The control unit 176 sets the air-suction force of the suction unit 96 on the basis of the information concerning the thickness of the printing paper. While the microswitch 31*b* is held OFF, for example, the air-flow of the suction unit 96 as the blower is set to f1, whereas while the microswitch 31*b* is held ON, the air-flow of the suction unit 96 as the blower is set to f2.

Although the control of the air-suction force of the suction unit 96 is assumed on the basis of information on only the thickness of printing sheet, the control thereof may be effected on the basis of information on the density of printing sheet (mass per unit area). In this case, the air-suction force of the suction unit 96 is set so that it is increased as the density of printing sheet is increased and the driving voltage of the motor in the suction unit 96 is variably controlled in a manner that makes the set air-suction force attainable. Further, information for use in determining the air-suction force of the suction unit 96 may be information deriving from a combination of thickness and density of printing sheet.

The variable control of the air-suction force (air-flow) of the suction unit 96 may be assumed by varying the on/off duty ratio of the driving motor in the suction unit 96 in addition to variably controlling the driving voltage of the motor in the suction unit 96.

In this embodiment, a stencil printing machine is used for an image forming machine of the image forming apparatus of the invention. However, various image forming machines, such as a copying machine, a printer and the like, may be used in the image forming apparatus of the present invention.

As set forth above, according to the present invention, printing paper can be conveyed with stability, irrespective of the thickness and the like of the printing sheet since the air-suction force of the air-suction means in the conveyer means is controlled in accordance with the thickness and density thereof. Therefore, a paper jam percentage in the travel route becomes suppressible and beside not only the wasting of printing sheet but also the interruption of the printing operation is reducible.

What is claimed is:

1. An image forming apparatus comprising:

image forming means for forming an image on a printing sheet;

a sheet post-processing unit provided downstream of the image forming means as viewed in a sheet conveying direction;

conveyer means having a belt and air-suction means for drawing the printing sheet to the belt, for conveying the printing sheet discharged from the image forming means toward the sheet post-processing unit;

printing sheet information input means for inputting information concerning a thickness of the printing sheet; and control means for controlling an air-suction force of the air-suction means of the conveyer means in response to an output of the printing sheet information input means.

2. The image forming apparatus according to claim 1, wherein the printing sheet information input means inputs to the control means information concerning the thickness of the printing sheet in the form of a signal which is turned on or off as a sheet-feed-pressure of the printing sheet supplied to the image forming means varies.

3. The image forming apparatus according to claim 1, wherein the printing sheet information input means inputs to the control means information concerning the thickness of the printing sheet in the form of a key signal which is generated in accordance with the thickness of the printing sheet.

4. An image forming apparatus comprising:

image forming means for forming an image on a printing sheet;

a sheet post-processing unit provided downstream of the image forming means as viewed in a sheet conveying direction;

conveyer means having a belt and air-suction means for drawing the printing sheet to the belt, for conveying the printing sheet discharged from the image forming means toward the sheet post-processing unit;

printing sheet information input means for inputting information concerning a density of the printing sheet; and control means for controlling an air-suction force of the air-suction means of the conveyer means in response to an output of the printing sheet information input means.

5. The image forming apparatus according to claim 4, wherein the printing sheet information input means inputs to the control means information concerning the density of the printing sheet in the form of a key signal which is generated in accordance with the density of the printing sheet.

6. An image forming apparatus comprising:

image forming means for printing an image on a printing sheet;

a plurality of bins arranged in a vertical direction;

first conveyer means having a belt and air-suction means, for conveying the printing sheet discharged from image forming means while drawing the printing sheet to the belt by the air-suction means of the first conveyer means;

second conveyer means having a belt provided vertically along the plurality of bins and coupled to a downstream-side portion of the first conveyer means and air-suction means as viewed in a sheet conveying direction, for receiving the printing sheet conveyed by the first conveyer means and vertically conveying downward while drawing the printing sheet to the belt by the air-suction means of the second conveyer means;

distributing means for distributing the printing sheet conveyed by the second conveyer means into the plurality of corresponding bins, respectively;

control means for controlling driving the first conveyer means, the second conveyer means and the distributing means in accordance with the printing sheet discharged from the image forming means; and printing sheet information input means for inputting information concerning a thickness of the printing sheet, wherein the control means controls an air-suction force of the air-suction means of the second conveyer means in response to an output of the printing sheet information input means.

7. The image forming apparatus according to claim 6, wherein the printing sheet information input means inputs to the control means information concerning the thickness of the printing sheet in the form of a signal which is turned on or off as a sheet-feed-pressure of the printing sheet supplied to the image forming means varies.

8. The image forming apparatus according to claim 6, wherein the printing sheet information input means inputs to the control means information concerning the thickness of the printing sheet in the form of a key signal which is generated in accordance with the thickness of the printing sheet.

9. An image forming apparatus comprising:

image forming means for printing an image on a printing sheet;

a plurality of bins arranged in a vertical direction;

first conveyer means having a belt and air-suction means, for conveying the printing sheet discharged from image forming means while drawing the printing sheet to the belt by the air-suction means of the first conveyer means;

second conveyer means having a belt provided vertically along the plurality of bins and coupled to a downstream-side portion of the first conveyer means and air-suction means as viewed in a sheet conveying direction, for receiving the printed sheet conveyed by the first conveyer means and vertically conveying downward while drawing the printing sheet to the belt by the air-suction means of the second conveyer means;

distributing means for distributing the printing sheet conveyed by the second conveyer means into the plurality of corresponding bins, respectively;

control means for controlling driving the first conveyer means, the second conveyer means and the distributing means in accordance with the printing sheet discharged from the image forming means; and printing sheet information input means for inputting information concerning a density of the printing sheet, wherein the control means controls an air-suction force of the air-suction means of the second conveyer means in response to an output of the printing sheet information input means.

10. The image forming according to claim 9, wherein the printing sheet information input means inputs to the control means information concerning the density of the printing sheet in the form of a key signal which is generated in accordance with the density of the printing sheet.

11. A sorter for sorting a printed sheet discharged from an image forming machine, the sorter comprising:

a plurality of bins arranged in a vertical direction;

a conveyer provided vertically along the plurality of bins to convey the printed sheet vertically downward, the conveyer having a belt and a suction unit for drawing the printed sheet to the belt;

an indexer having a guide surface in its upper portion, being vertically movable along a sheet travel route of the conveyer, for peeling the printed sheet off the conveyer with the guide surface and sending the printed sheet in either one of the plurality of bins;

a controller connecting to the conveyer and the indexer, for driving the conveyer and the indexer; and an operating panel connecting to the controller, wherein the operating panel receives a printing sheet information of the sheet to be printed and feeds the information to the controller, and the controller determines an air-suction force of the suction unit of the conveyer in response to the information from the operating panel.

12. The sorter according to claim 11, wherein the information of the sheet in the operating panel includes a thickness of the sheet to be printed.

13. The sorter according to claim 11, wherein the information of the sheet in the operating panel includes a density of the sheet to be printed.

* * * * *